United States Patent [19]

Fikse

[11] Patent Number: 4,527,457

[45] Date of Patent: Jul. 9, 1985

[54] RECOILLESS ELECTROMAGNETIC PROJECTILE LAUNCHER

[75] Inventor: Douglas A. Fikse, Pittsburgh, Pa.

[73] Assignee: Westinghouse Electric Corp., Pittsburgh, Pa.

[21] Appl. No.: 483,800

[22] Filed: Apr. 11, 1983

[51] Int. Cl.[3] ..... F41F 1/00

[52] U.S. Cl. ..... 89/8; 89/1.7; 124/3; 310/13; 318/315

[58] Field of Search ..... 89/1.7, 1.701, 1.702, 89/1.703, 1.704, 8; 124/3; 310/10-14; 318/315

[56] References Cited

U.S. PATENT DOCUMENTS

| | | | |
|---|---|---|---|
| 2,679,192 | 5/1954 | Seeley et al. | 89/1.701 X |
| 3,013,472 | 12/1961 | Kahn et al. | 89/1.7 |
| 3,431,816 | 3/1969 | Dale | 89/8 |
| 3,610,093 | 10/1971 | Mebus | 89/1.7 |
| 4,043,248 | 8/1977 | Bulman et al. | 89/1.703 |
| 4,157,054 | 6/1979 | Cobb | 89/1.7 X |
| 4,244,293 | 1/1981 | Grosswendt et al. | 89/1.701 X |
| 4,347,463 | 8/1982 | Kemeny et al. | 89/8 |
| 4,369,691 | 1/1983 | Baehr, Jr. et al. | 89/8 |
| 4,404,887 | 9/1983 | Pieski | 89/1.703 |

FOREIGN PATENT DOCUMENTS

| | | | |
|---|---|---|---|
| 2496250 | 6/1982 | France | 89/1.7 |
| 2514882 | 4/1983 | France | 89/1.701 |

*Primary Examiner*—David H. Brown
*Assistant Examiner*—John E. Griffith
*Attorney, Agent, or Firm*—Robert P. Lenart

[57] ABSTRACT

A recoilless electromagnetic projectile launcher is provided with a pair of projectile launching conductors, a source of high current, a sliding armature for conducting current between the conductors and propelling a projectile, and a structure which creates a force which is equal but opposite to a recoil force created as the projectile is accelerated. This structure includes a second pair of conductors for accelerating a recoil mass in a direction opposite to the direction of travel of the projectile or, alternatively, an expansion chamber and nozzle for accelerating hot gases resulting from the creation of a plasma armature, in a direction opposite to the direction of travel of the projectile. The projectile launcher of this invention operates in accordance with a method of accelerating a projectile which includes conducting current between a pair of projectile launching conductors through a movable conductive armature thereby creating an electromagnetic force which accelerates an armature and the projectile along the conductors, and accelerating a mass to create a reaction force which is substantially equal to but in the opposite direction of a recoil force associated with the electromagnetic acceleration of the projectile.

9 Claims, 2 Drawing Figures

RECOILLESS ELECTROMAGNETIC PROJECTILE LAUNCHER

BACKGROUND OF THE INVENTION

This invention relates to electromagnetic projectile launching systems, and more particularly to such systems wherein the recoil force is balanced by a substantially equal but opposite force resulting from an exhaust jet or the acceleration of a recoil mass in a direction opposite to the direction of projectile travel.

Electromagnetic projectile launchers are known which comprise a pair of conductive rails, a sliding conductive armature between the rails, a source of high current and a switch for commutating this current into the rails and through the armature. Current flow through the rails and armature results in an electromagnetic force on the armature which propels it along the conductive rails. Both sliding metallic and plasma armatures have been used. During acceleration of the projectile, a force which opposes the projectile acceleration is generated. This force is called the recoil force.

The substantial forces generated during electromagnetic acceleration of a projectile must be absorbed by large recoil structures which may be immobile, as in laboratory launchers, or energy absorbing, as in mobile launchers. While laboratory systems are capable of massive fixed recoil structures, mobile launchers do not have this luxury. Since it is desirable to limit the weight of mobile launchers, a suitable recoil structure must be non-fixed and able to dissipate large amounts of energy. One concept which has been used successfully in the chemical gun field is the recoilless launcher. The concept of a recoilless launcher follows a conservation of momentum principle to balance the recoil force. If an equal but opposite force is applied during a launch, the launcher barrel experiences zero motion, and therefore no recoil structure is needed. Electromagnetic projectile launchers constructed in accordance with the present invention utilize either an exhaust jet or the acceleration of a recoil mass to create a reaction force which balances the recoil force.

SUMMARY OF THE INVENTION

Recoilless electromagnetic projectile launchers constructed in accordance with this invention comprise: a pair of generally parallel conductors; means for propelling a projectile along these conductors and for conducting current therebetween; a source of electric current connected to the conductors; means for switching current from the source to the conductors, whereby current required for launching a projectile at a predetermined velocity is transferred to the conductors; and means for creating a reaction force, which is substantially equivalent to but in the opposite direction of the recoil force. In order to create the reaction force, a launcher may further comprise: a second pair of generally parallel conductors; means for propelling a recoil mass between the second pair of conductors and for conducting current therebetween, wherein the recoil mass is propelled in the direction opposite to the direction in which the projectile is propelled; and means for connecting the second pair of conductors in series between the source of high current and the first pair of conductors, such that launch current flows through all four conductors. Alternatively, the reaction force may be created by an exhaust jet in which case, the launcher would further comprise: an expansion chamber having an aperture in one side which adjoins a gap between the first pair of conductors at one end thereof; and a nozzle in the other side of the expansion chamber, wherein the other side is diametrically opposite the first side. The exhaust jet launcher utilizes a plasma for conducting current between the first pair of rails and for propelling a projectile along the rails.

On another level, this invention also encompasses a method of electromagnetically accelerating a projectile comprising the steps of: connecting a source of electric current to a pair of generally parallel conductors; conducting current between the conductors through a movable conductive armature, whereby current flow through the conductors and the armature creates an electromagnetic force which accelerates the armature and an associated projectile along the conductors in a first direction; and accelerating a mass to create a reaction force, which is substantially equal to but in the opposite direction of a recoil force associated with the electromagnetic acceleration of the projectile. The acceleration of a mass to create a reaction force can take the form of expanding hot gases associated with the formation of a plasma in an expansion chamber, and subsequently passing the gases through a nozzle in a direction opposite to the direction of travel of the projectile. Alternatively, a recoil mass can be accelerated between a second pair of conductors in a direction opposite to the direction of travel of the projectile, thereby creating the reaction force.

DESCRIPTION OF THE PREFERRED EMBODIMENTS

Figure 1:
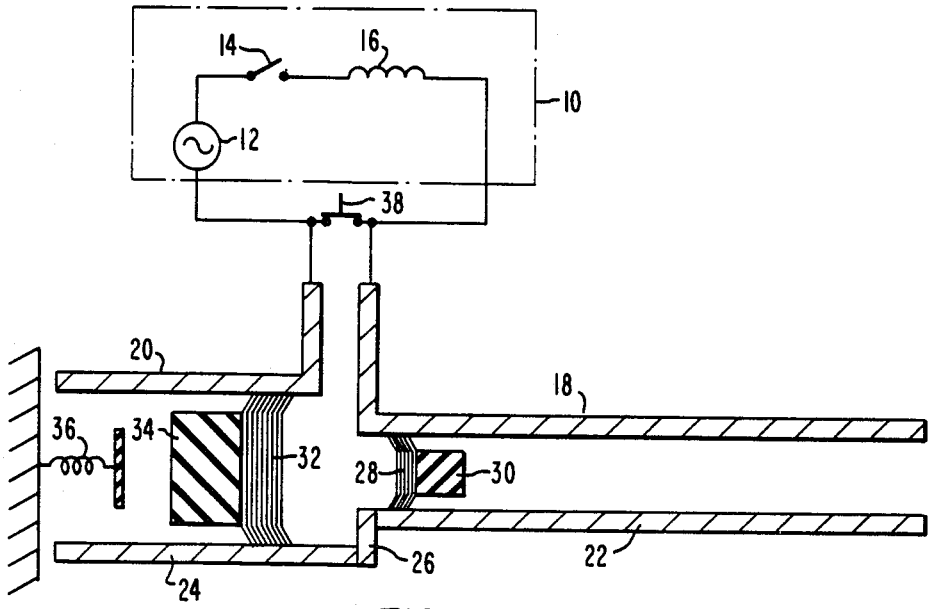
FIG. 1 is a schematic diagram of an electromagnetic projectile launcher constructed in accordance with one embodiment of the present invention.

Referring to the drawings, FIG. 1 is a schematic diagram of an electromagnetic projectile launcher constructed in accordance with one embodiment of this invention. A source of high current 10 comprising the series connection of generator 12, switch 14 and inductive energy storage means 16, is connected between a first conductor in the form of a projectile launching rail 18 and a second conductor in the form of a recoil mass accelerating rail 20. A third conductor in the form of a projectile launching rail 22 is disposed in a generally parallel relationship with projectile launching rail 18, while a fourth conductor in the form of a recoil mass accelerating rail 24 is disposed in a generally parallel relationship with recoil mass accelerating rail 20. Conductive rails 22 and 24 are electrically connected through conductive shunt 26. In this embodiment, the first and third conductors are disposed an equal distance from but on opposite sides of a central axis, while the second and fourth conductors are disposed an equal distance from but on opposite sides of the same axis. In order to achieve substantially balanced forces, the width-to-height ratios of the bores between both the projectile launching rails and the recoil mass accelerating rails are substantially equivalent. A sliding conductive armature 28 is positioned between projectile launching rails 18 and 20 and serves as a means for conducting current between these rails and for propelling projectile 30 along the rails. A second sliding conductive armature 32 is positioned between the recoil mass accelerating rails 20 and 24 and serves as a means for conducting current between these rails and for propelling recoil mass 34 along the rails. A shock-absorbing mans 36 is provided to stop the movement of recoil mass 34 following a launch. Firing switch 38 is connected between rails 18 and 20 and serves as a means for switching current from the current source 10 into rails 18 and 20.

Prior to a launch, conductive armatures 28 and 32, projectile 30 and recoil mass 34 are positioned as shown in FIG. 1 near the breech ends of projectile launching rails 18 and 22 and recoil mass accelerating rails 20 and 24, respectively. Switches 14 and 38 are initially closed to allow generator 12 to charge inductive energy storage device 16 to a predetermined firing current. When this predetermined firing current has been achieved, firing switch 38 is opened, thereby commutating the firing current into rails 18 and 20. Then current flows through portions of each of the rails and through armatures 28 and 32, thereby creating an electromagnetic force which accelerates armature 28 and projectile 30 to the right along projectile launching rails 18 and 22, and accelerates armature 32 and recoil mass 34 to the left along recoil mass accelerating rails 20 and 24. Since both the projectile and recoil mass, with their associated armatures, are accelerated by substantially the same electromagnetic force, the momentum of the projectile and armature should be substantially equal to the momentum of the recoil mass and armature. During the launch, the force which opposes the acceleration of armature 28 and projectile 30 along the projectile launching rails is the recoil force. It should be apparent that by accelerating recoil mass 34 and armature 32 in the opposite direction, an equal but opposite force is applied during the launch. Therefore, a launcher barrel which includes rails 18, 20, 22 and 24 experiences zero net force in the direction of travel of the projectile. By making the mass of recoil mass 34 large compared to the mass of projectile 30, the velocity of the recoil mass need not be high to match the momentum of the light mass, high velocity projectile. At projectile exit, when recoil mass 34 has traveled a predetermined distance, it can be stopped with shock-absorbing means 36. Armature 32 remains in the circuit during the entire launch. Armature 32 and recoil mass 34 are accelerated by the same electromagnetic force as armature 28 and projectile 30, but do not develop a large kinetic energy.

Selected parameters of a proposed electromagnetic projectile launcher, in accordance with FIG. 1, are listed in Table I.

TABLE I

| | |
|---|---|
| Projectile/Armature Mass | 50 g |
| Projectile Exit Velocity | 3 km/sec |
| Recoil Force | 62.5 kN |
| Projectile Muzzle Energy | 225 kJ |
| Recoil Mass/Armature Mass | 20 kg |
| Recoil Mass Final Velocity | 7.5 m/sec |
| Recoil Energy | 563 J |

The dissipation of 563 joules is considered to be a minor task, especially at the low 7.5 m/sec velocity. After a launch, the recoil mass and associated armature would be reloaded. With this launcher, some system energy is lost in accelerating the large recoil mass. However, the amount of additional stored energy required will be minimal since only a small fraction of the total energy is utilized as final kinetic energy.

The electromagnetic projectile launcher of FIG. 1 operates in accordance with a method of accelerating projectiles comprising the steps of: connecting a source of electric current to a pair of generally parallel conductors; conducting current between the conductors and through a movable conductive armature, whereby current flow through the conductors and the armature creates an electromagnetic force which accelerates the armature and an associated projectile along the conductors in a first direction; and accelerating a mass to create a reaction force, which is substantially equal to but in the opposite direction of a recoil force associated with the electromagnetic acceleration of the projectile. In this embodiment, recoil mass 34 is electromagnetically accelerated between recoil mass accelerating rails 20 and 24. Although the same current flows in both armatures, their positions between the rails result in current flow in armature 32 being in the opposite direction of current flow in armature 28.

Figure 2:
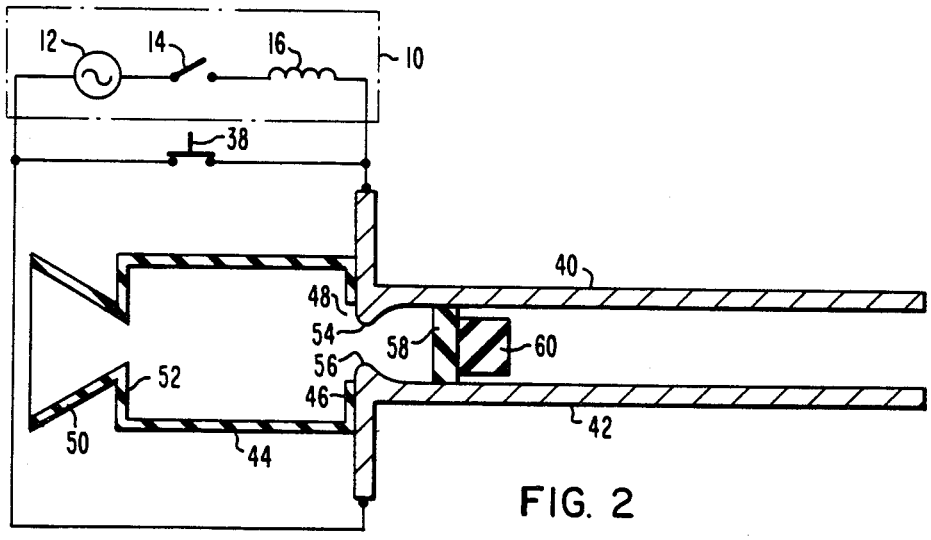
FIG. 2 is a schematic diagram of an electromagnetic projectile launcher constructed in accordance with an alternative embodiment of this invention.

FIG. 2 is a schematic diagram of an electromagnetic projectile launcher constructed in accordance with an alternative embodiment of the present invention. In this embodiment, high current source 10 is connected to a pair of conductors in the form of generally parallel projectile launching rails 40 and 42. An expansion chamber 44 is positioned adjacent to the breech end of projectile launching rails 40 and 42 and includes a first side 46 having an opening 48 adjoining the breech end of the projectile launching rails. A nozzle 50 is located in a second side 52 which is diametrically opposed to the first side 46. Projectile launching rails 40 and 42 include projections 54 and 56, respectively, at the breech end to facilitate the formation of a plasma armature during a launch. Alternatively, a known means for creating a plasma such as a fuse or exploding wire may be inserted at the breech end of the projectile launching rails. An insulating bore sealing sabot 58 is provided behind projectile 60 and pevents leakage of the driving plasma around the projectile. During a launch, switches 14 and 38 are initially closed to allow generator 12 to charge inductive energy storage means 16 to a predetermined firing current. When this predetermined firing current has been achieved, firing switch 38 is opened, thereby commutating the firing current into projectile launching rails 40 and 42. This current is used to create a plasma between projections 54 and 56 which serves as a means for conducting current between rails 40 and 42 and for propelling projectile 60 along these rails. The plasma also creates hot gases which expand into expansion chamber 44 and pass through nozzle 50 to create a rocket engine effect. This jet blast of hot gases would be of short duration but should be adequate to counter the recoil force since the main recoil force is applied at the beginning of the launch.

The launcher of FIG. 2 accelerates a projectile in accordance with a method of projectile acceleration comprising the steps of: connecting a source of electric current to a pair of generally parallel conductors; conducting current between the conductors and through a movable conductive armature, whereby current flow through the conductors and armature creates an electromagnetic force which accelerates the armature and an associated projectile along the conductors in a first direction; and accelerating a mass, which in this case is comprised of hot gases, to create a reaction force which is substantially equal to but in the opposite direction of a recoil force associated with the electromagnetic acceleration of the projectile.

While this invention has been described in terms of what are at present believed to be the preferred embodiments, it will be apparent to those skilled in the art that various changes may be made to these embodiments without departing from the scope of the invention. For example, in FIG. 1, the mass of armature 32 can be made sufficiently large so that a separate recoil mass 34 is unnecessary. In addition, although the armatures of FIG. 1 are illustrated as being comprised of a plurality of conductive sheets, other known armature configurations may also be used. It is therefore intended that the appended claims cover all such changes that fall within the scope of the invention.

I claim:

1. A recoilless electromagnetic projectile launcher comprising:

a first conductor;

a second conductor disposed generally parallel to said first conductor;

means for propelling a projectile from a first end of said first and second conductors to a second end thereof and for conducting current therebetween;

a third conductor;

a fourth conductor disposed generally parallel to said third conductor;

means for propelling a recoil mass from a first end of said third and fourth conductors to a second end thereof and for conducting current therebetween, wherein said recoil mass is propelled in a direction opposite to the direction in which said projectile is propelled;

means for connecting said second and third conductors;

a source of electric current electrically connected to said first and fourth conductors; and means for switching current from said source to said first and fourth conductors, whereby the current required for launching said projectile at a predetermined velocity is transferred to said first, second, third and fourth conductors.

2. An electromagnetic projectile launcher as recited in claim 1, further comprising:

means for decelerating said recoil mass, after said recoil mass has traveled a predetermined distance.

3. An electromagnetic projectile launcher as recited in claim 1, wherein the combined mass of said means for propelling a projectile and said projectile is less than the combined mass of said means for propelling a recoil mass and said recoil mass.

4. An electromagnetic projectile launcher as recited in claim 1, wherein:

said means for propelling a projectile comprises a first conductive armature slidably disposed between said first and second conductors; and said means for propelling a recoil mass comprises a second conductive armature slidably disposed between said third and fourth conductors.

5. An electromagnetic projectile launcher as recited in claim 1, wherein:

current flow through said means for propelling a projectile, during a launch, is in a direction which is opposite of the direction of current flow through said means for propelling a recoil mass.

6. An electromagnetic projectile launcher as recited in claim 1, wherein:

the magnitude of current flowing in said means for propelling a projectile is equal to the magnitude of current flowing through said means for propelling a recoil mass.

7. An electromagnetic projectile launcher as recited in claim 1, wherein said third and fourth conductors are disposed an equal distance form and on opposite sides of a central axis and said first and second conductors are disposed an equal distance from and on opposite sides of said, central axis.

8. An electromagnetic projectile launcher as recited in claim 7, wherein said first and fourth conductors lie on one side of said central axis and said second and third conductors lie on the opposite side of said central axis.

9. A method of electromagnetically accelerating a projectile, comprising the steps of:

connecting a source of electric current between first and second conductors wherein said first conductor is generally parallel to a third conductor, said second conductor is generally parallel to a fourth conductor, and said third and fourth conductors are electrically connected together;

conducting current between said first and third conductors through a first sliding conductive armature, whereby current flow through said first and third conductors and said first armature creates an electromagnetic force which propels said first armature and an associated projectile along said first and third conductors in a first direction; and conducting current between said second and fourth conductors through a second sliding conductive armature, whereby current flow through said second and fourth conductors and said second armature creates an electromagnetic force which propels said second armature and an associated recoil mass along said second and fourth conductors in a second direction opposite to said first direction.

* * * * *